US006953901B2

(12) United States Patent
Onodera

(10) Patent No.: US 6,953,901 B2
(45) Date of Patent: Oct. 11, 2005

(54) FORCE SENSE IMPARTING TYPE INPUT APPARATUS

(75) Inventor: Mikio Onodera, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/684,808

(22) Filed: Oct. 14, 2003

(65) Prior Publication Data

US 2004/0140950 A1 Jul. 22, 2004

(30) Foreign Application Priority Data

Oct. 17, 2002 (JP) ..... 2002-303392

(51) Int. Cl.[7] ..... H01H 9/00

(52) U.S. Cl. ..... 200/6 A; 200/4; 200/5 R; 200/17 R

(58) Field of Search ..... 200/6 A, 17 R, 200/18, 4, 5 R, 6 R, 1 R, 329; 345/161, 156; 74/471

(56) References Cited

U.S. PATENT DOCUMENTS

| | | | | |
|---|---|---|---|---|
| 3,818,154 A | | 6/1974 | Presentey | |
| 5,107,080 A | * | 4/1992 | Rosen | 200/6 A |
| 5,264,821 A | * | 11/1993 | Vultaggio et al. | 338/172 |
| 5,473,325 A | * | 12/1995 | McAlindon | 341/20 |
| 6,101,893 A | * | 8/2000 | Wergen | 74/471 X |
| 6,160,537 A | * | 12/2000 | Liu et al. | 345/161 |
| 6,201,196 B1 | * | 3/2001 | Wergen | 200/6 A |
| 6,429,849 B1 | | 8/2002 | An | |
| 6,611,139 B1 | * | 8/2003 | Jackson | 324/207.2 |
| 2001/0030658 A1 | | 10/2001 | Rosenberg et al. | |
| 2002/0057064 A1 | | 5/2002 | Onodera | |

FOREIGN PATENT DOCUMENTS

| | | |
|---|---|---|
| EP | 0 628 976 | 4/1994 |
| JP | 2002-189560 | 7/2002 |
| WO | WO 93/18475 | 9/1993 |

* cited by examiner

*Primary Examiner*—K. Richard Lee
(74) *Attorney, Agent, or Firm*—Brinks Hofer Gilson & Lione

(57) ABSTRACT

A force sense imparting type input apparatus includes an exterior decoration plate having an opening, an operation lever supported by a stick controller positioned inside the exterior decoration plate in such a manner as to be capable of rocking, encoders for detecting a rocking amount and a rocking direction of the operation lever, motors for imparting desired external force to the operation lever, and a control unit for controlling driving of the motors on the basis of an output signal outputted from the encoders, wherein an operation knob is provided to an upper end of the operation lever protruding outward from the opening, and can be pushed or pulled in an axial direction of the operation lever with a neutral position of the operation knob as a reference, and the push-pull operation of the operation knob selectively operates first and second push switches.

10 Claims, 9 Drawing Sheets

FORCE SENSE IMPARTING TYPE INPUT APPARATUS

BACKGROUND OF THE INVENTION

1. Field of the Invention

This invention relates to a force sense imparting type input apparatus having a force feedback function for imparting external force such as a resistance feeling, propelling force, etc, to an operator operating and rocking an operation lever in accordance with an operating condition of the operation lever. More particularly, the invention relates to a force sense imparting type input apparatus that will be suitable when used for car-mounted controlling apparatuses.

2. Description of the Related Art

A force sense imparting type input apparatus having a force feedback function has been proposed in recent years. When adjustment of functions of car-mounted controlling apparatuses such as an air conditioner, a car audio apparatus, a car navigation apparatus, etc, is consolidated into one operation lever and selection of the apparatuses and function adjustment of the selected apparatus are conducted through this operation lever, the force sense imparting type input apparatus renders an operation feeling pleasant and makes maneuverability more reliable by imparting external force such as a resistance feeling, propelling force, etc in accordance with an operation amount and an operation direction of the operation lever.

As a force sense imparting type input apparatus of this kind, an apparatus is known that includes detection means for detecting an operation amount of an operation lever and its operation direction, an actuator for imparting external force to the operation lever and control means for controlling driving of the actuator on the basis of an output signal outputted from the detection means (refer to Patent Reference 1, for example).

The detection means described above includes a conversion portion for converting rocking motion of an operation lever to rotary motion of two rotary bodies orthogonally intersecting each other, and a detection portion such as a rotary encoder for converting the rotation amounts of these two rotary bodies and their rotary directions into electric signals. The actuator comprises a motor, or the like. The control means stores the detection signal outputted from the detection portion of the detection means, outputs a desired control signal to the actuator on the basis of the detection signal and displays an operation position (cursor) of the operation lever on a monitor provided to an instrument panel inside the car. The control signal is a signal corresponding to an operation feeling imparted to the operation lever, and the kind of the signal includes generation of vibration and a change of operation force. Incidentally, an upper end of the operation lever protrudes from an external decoration surface of a center console box, or the like, inside the car, and a plurality of key switches for selecting functions of various apparatuses displayed on the monitor is arranged on this external decoration surface.

In the force sense imparting type input apparatus roughly constituted as described above, a selection menu representing various apparatuses such as an air conditioner, an audio apparatus, a car navigation apparatus, etc is displayed as an initial screen on a monitor. The operator can select a desired apparatus by pushing one of key switches of a key switch group, and can conduct function adjustment of the selected apparatus by rocking the operation lever. When, for example, the operator selects the air conditioner by pushing an arbitrary key switch, the monitor displays the functions of the air conditioner such as temperature adjustment and wind amount adjustment. When the inclining the operation lever in an arbitrary direction to move the cursor on the monitor, the operator can make temperature adjustment and wind amount adjustment. In this instance, the control means receives the detection signal outputted from the detection means and outputs a desired control signal to an actuator on the basis of the detection signal so that external force corresponding to the operation mount of the operation lever and its operation direction can be imparted to the operation lever. Therefore, the operator can know through blind touch that the operation lever is operated in the intended direction. The operation feeling can be improved and maneuverability can be made more reliable.

Patent Reference 1:

Japanese Unexamined Published Patent Application No. 2002-189560 (pages 4 to 6, FIG. 1)

When the function selection of the desired apparatus is made through the operation lever in the force sense imparting type input apparatus according to the prior art described above, the operator must conduct troublesome operations of first pushing one of key switches of a key switch group arranged in the proximity of the operation lever to select the apparatus, then moving the hand to the operation lever and selecting the function of the selected apparatus. Therefore, the force sense imparting type input apparatus is not easy to operate. The force sense imparting type input apparatus according to the prior art does not take a cancel operation of the function selection through the operation lever into account. When one of the key switches of the key switch group is caused to bear such a cancel operation, the operator must first operate the operation lever for rocking to select the function and must then transfer the hand to the key switch group to conduct the cancel operation. From this point, too, the force sense imparting type input apparatus is not free from the problem that is not easy to operate.

SUMMARY OF THE INVENTION

In view of the prior art technologies described above, the invention aims at providing a force sense imparting type input apparatus that makes it possible to conduct a rocking operation of an operation lever and a push-pull operation of a switch, has high maneuverability and is easy to operate.

To accomplish the object described above, the invention provides a force sense imparting type input apparatus comprising an exterior decoration plate having an opening an operation lever having a support point thereof positioned inside the exterior decoration plate and so supported as to be capable of rocking, detection means for detecting an operating condition of the operation lever, an actuator for imparting external force to the operation lever, and control means for controlling driving of the actuator on the basis of an output signal outputted from the detection means, wherein an operation knob is provided to an end part of the operation lever protruding outward from the opening, a push-pull operation is allowed in an axial direction of the operation lever with a neutral position of the operation knob as a reference, and the push-pull operation of the operation knob selectively operates two switches.

When the operation knob provided to the end part of the operation lever is pushed in the force sense imparting type input apparatus having such a construction, one of the switches is operated and when the operation knob is pulled, another switch is operated. Therefore, the operator can continuously conduct the rocking operation of the operation lever and the push/pull operation of the switch, maneuverability can be improved and the apparatus becomes easier to operate.

When the operation knob has a large diameter portion with the operation lever being its proximal end side and a protuberance portion protruding from this large diameter portion, the operator can put his fingers onto these large diameter portion and protuberance portion and can advantageously and easily conduct the push/pull operation. In this instance, when a constriction is defined at a part of the protuberance portion, the operator can easily conduct the push/pull operation while nipping the constriction of the protuberance portion with fingers. When a roughening surface treatment is applied to a ceiling surface of the protuberance portion, the operator can reliably conduct the push operation while putting his finger on the ceiling surface of the protuberance portion. Furthermore, when at least one of the large diameter portion and the protuberance portion has a rectangular planar shape, the operator can know through blind touch the rocking direction of the operation lever from the outer shape of the operation knob.

In the construction described above, it is possible to use switches of a slide type in which a moving contact comes close to and away from two sets of fixed contacts on a substrate as two switches. However, it is preferred to so arrange two push switches on the operation lever as to face each other and to interpose a pusher on the operation knob at a position between stems of the push switches. According to this construction, the operation knob can be stably held at a neutral position by means of return springs built in the two push switches, and wiring of both push switches can be made easily.

DESCRIPTION OF THE PREFERRED EMBODIMENT

Figure 1:
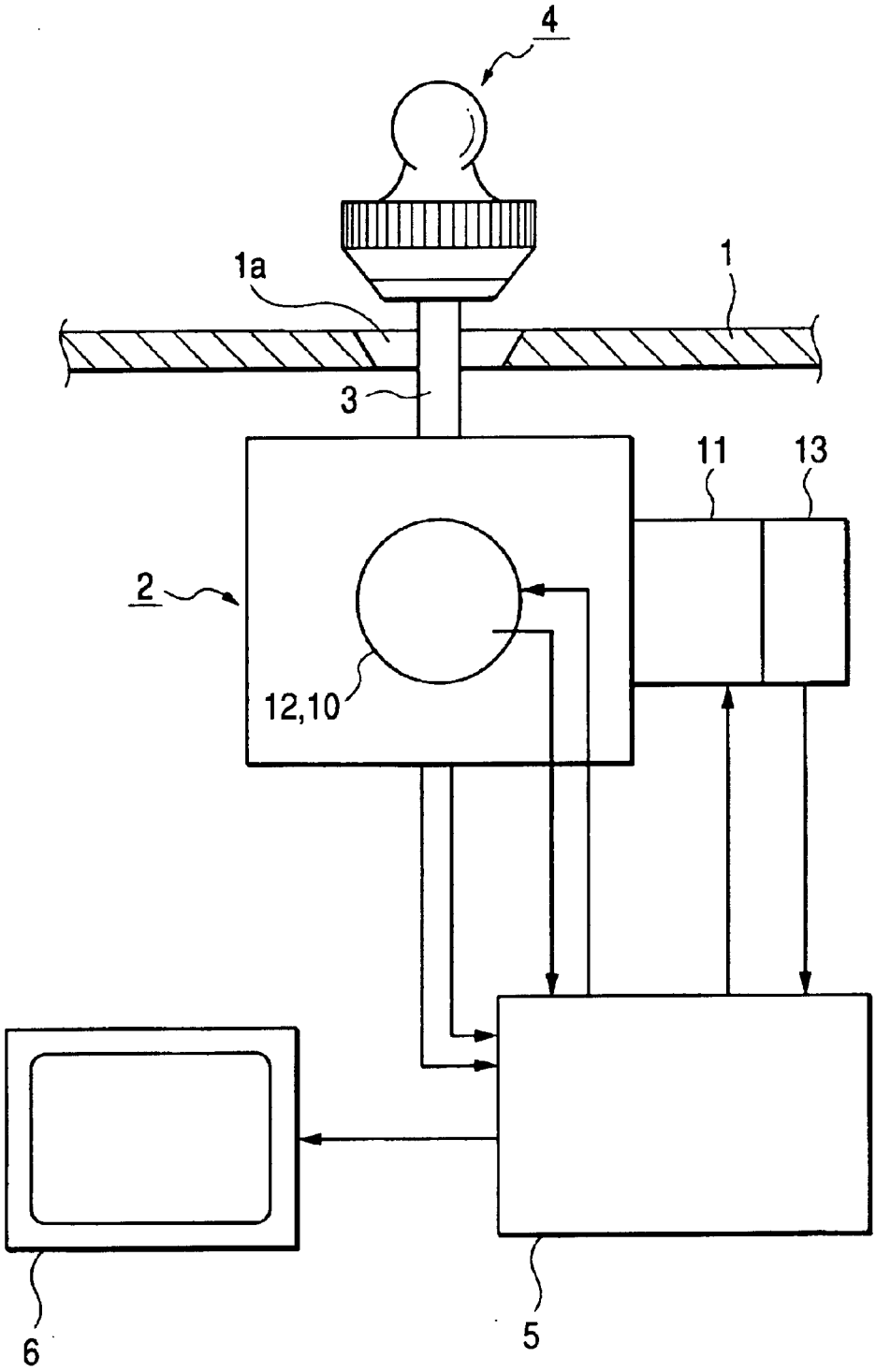
FIG. 1 is a structural view of a force sense imparting type input apparatus according to an embodiment of the invention.
Figure 2:
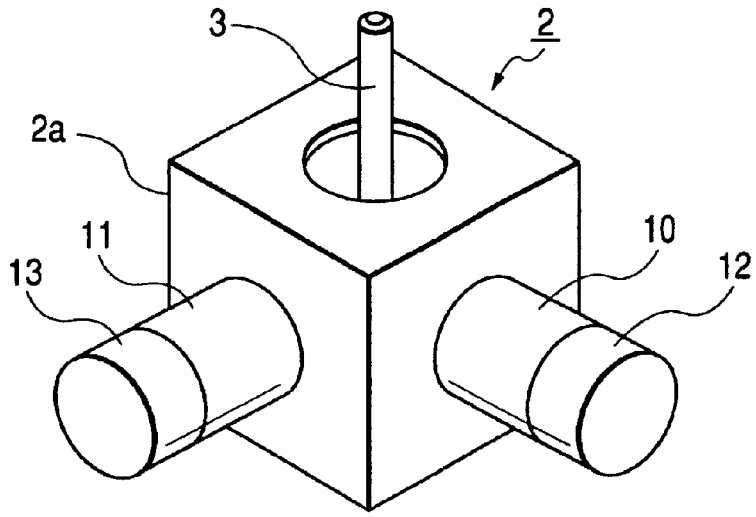
FIG. 2 is a perspective view of a stick controller provided to the force sense imparting type input apparatus.
Figure 3:
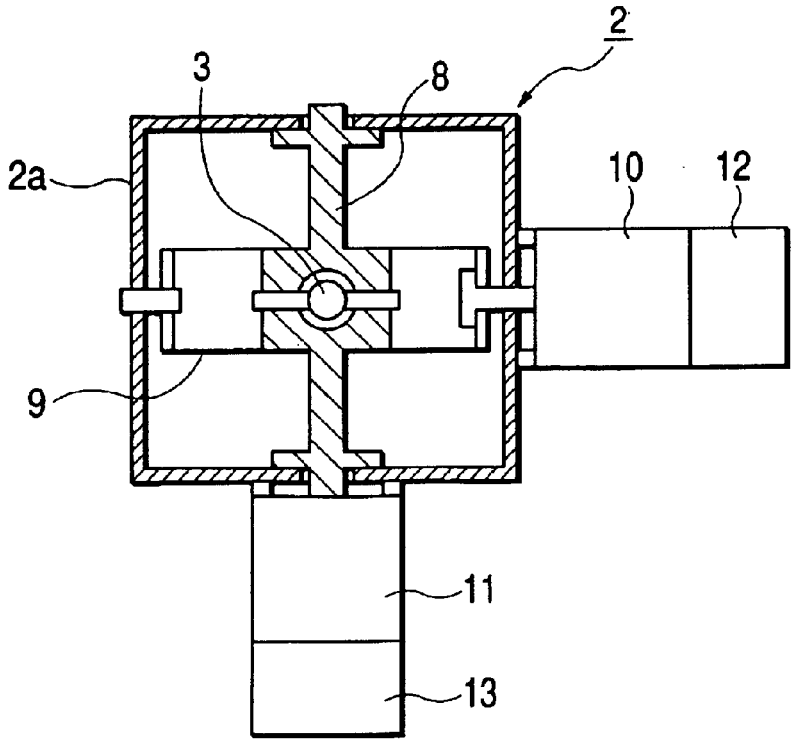
FIG. 3 is a transverse sectional view of the stick controller.
Figure 4:
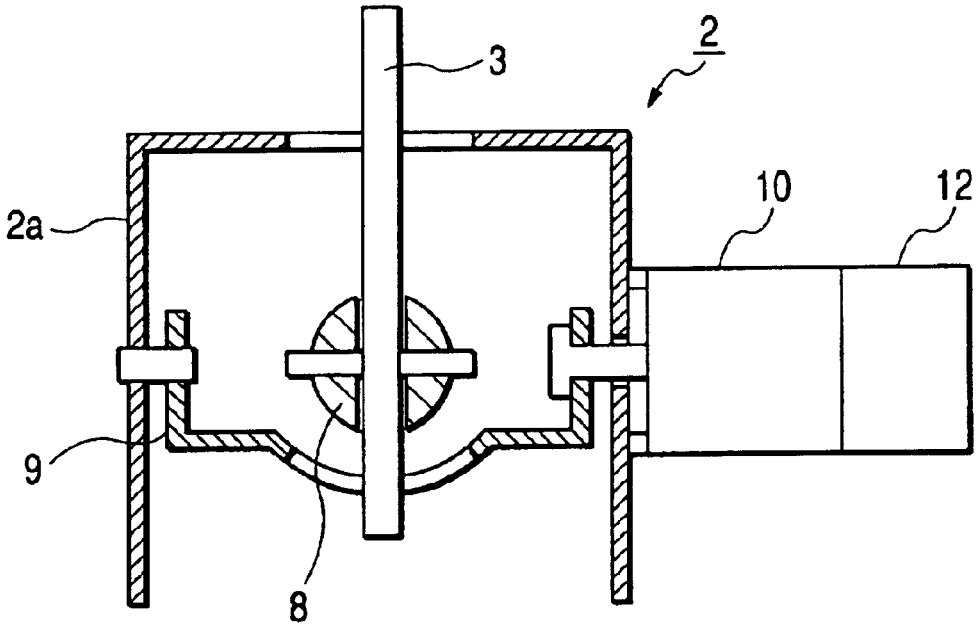
FIG. 4 is a longitudinal sectional view of the stick controller.
Figure 5:
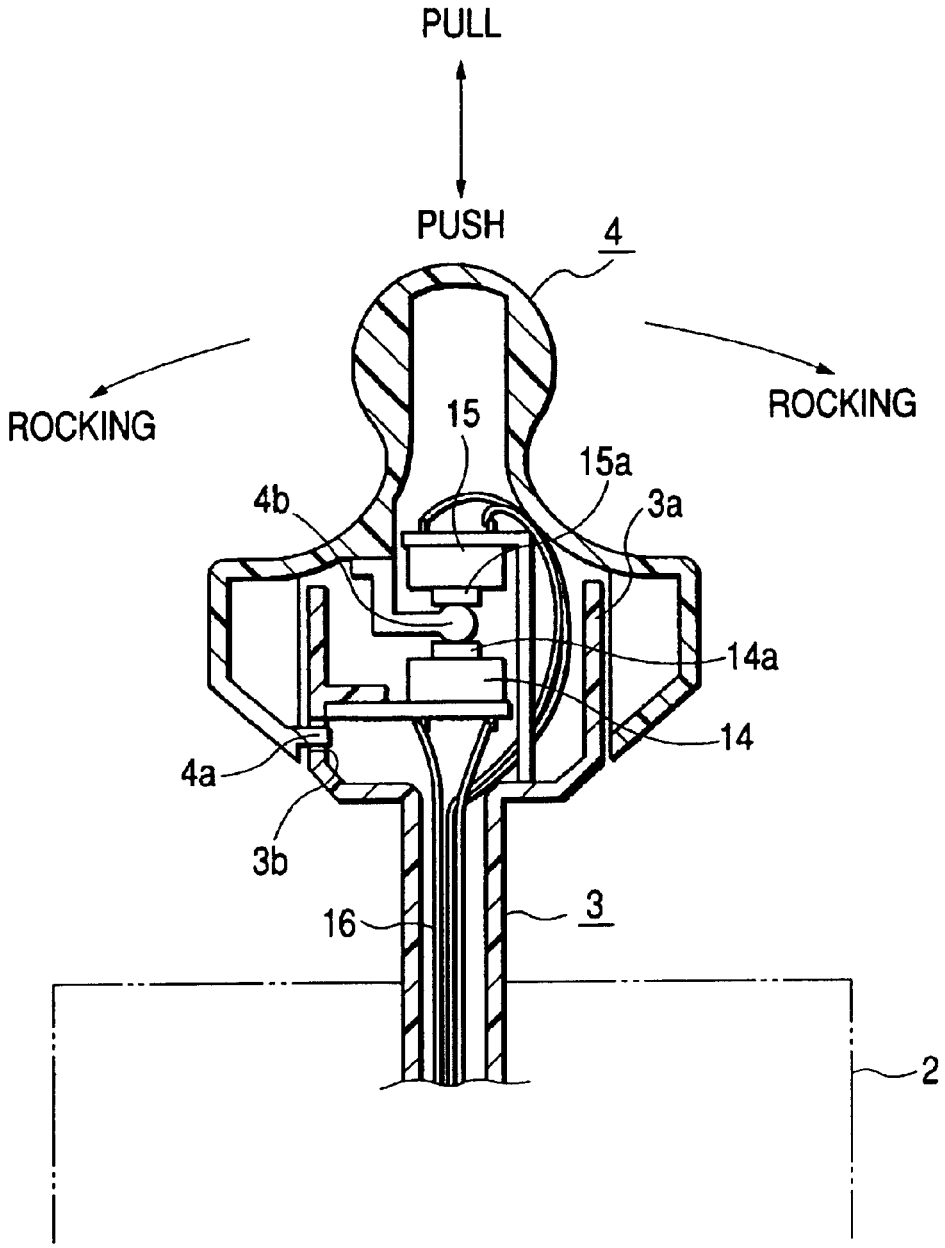
FIG. 5 is a sectional view showing an internal construction of an operation knob provided to the force sense imparting type input apparatus.
Figure 6:
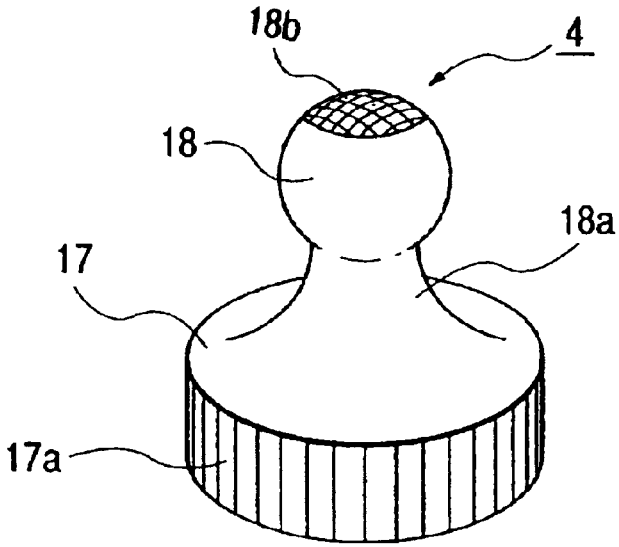
FIG. 6 is a perspective view of the operation knob.
Figure 7A:
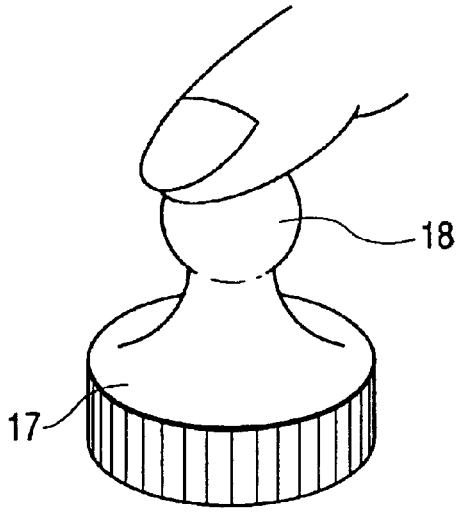
FIGS. 7A, 7B, 7C and 7D are explanatory views useful for explaining an operation example of the operation knob.
Figure 7B:
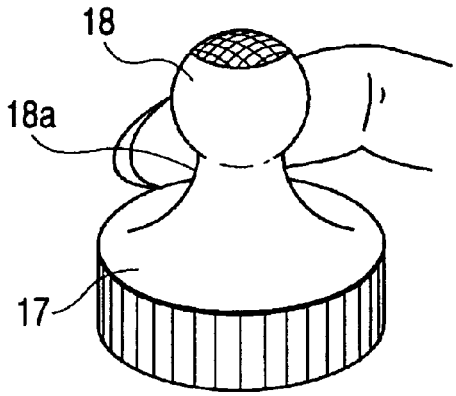
Figure 7C:
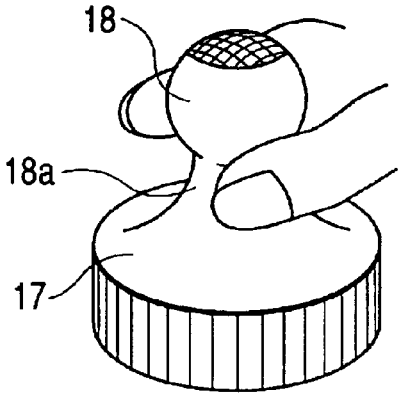
Figure 7D:
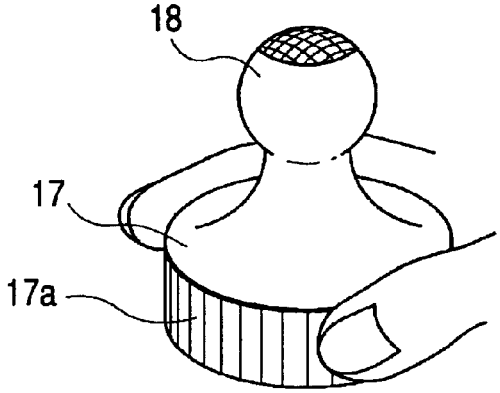
Figure 8:
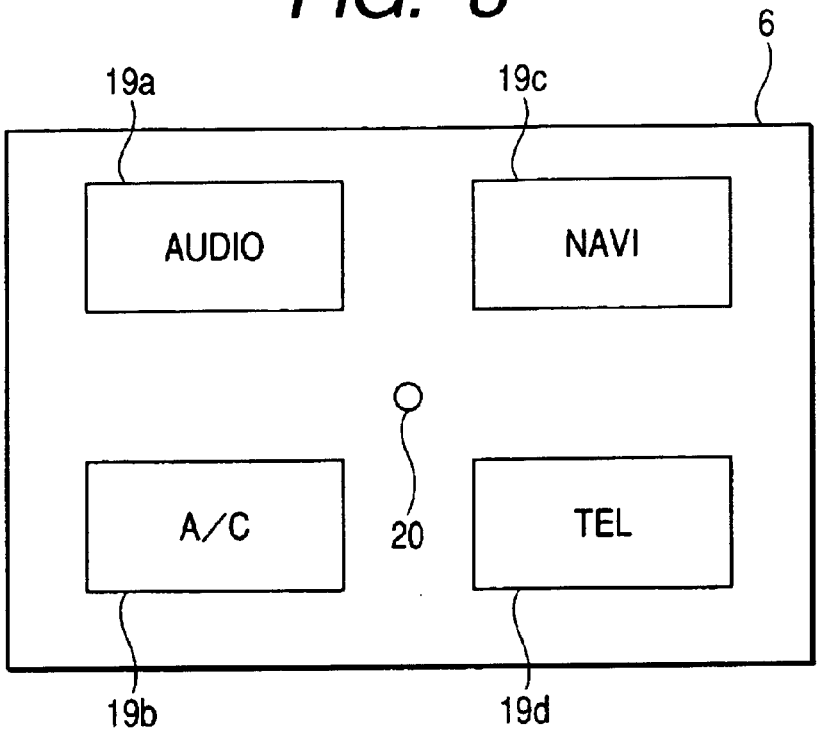
FIG. 8 is an explanatory view useful for explaining a display content of a monitor.
Figure 9:
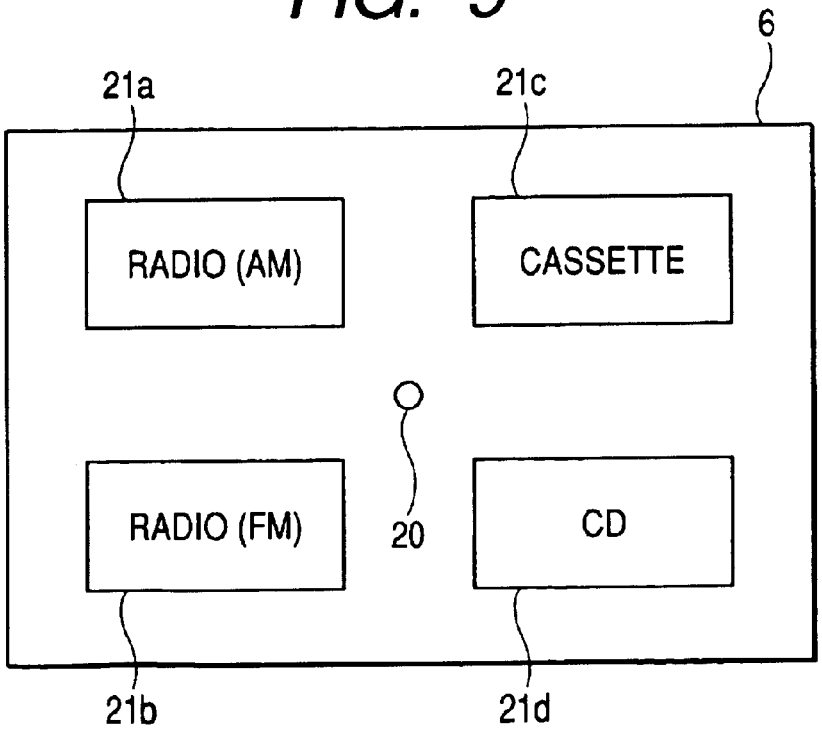
FIG. 9 is also an explanatory view useful for explaining a display content of the monitor.
Figure 10:
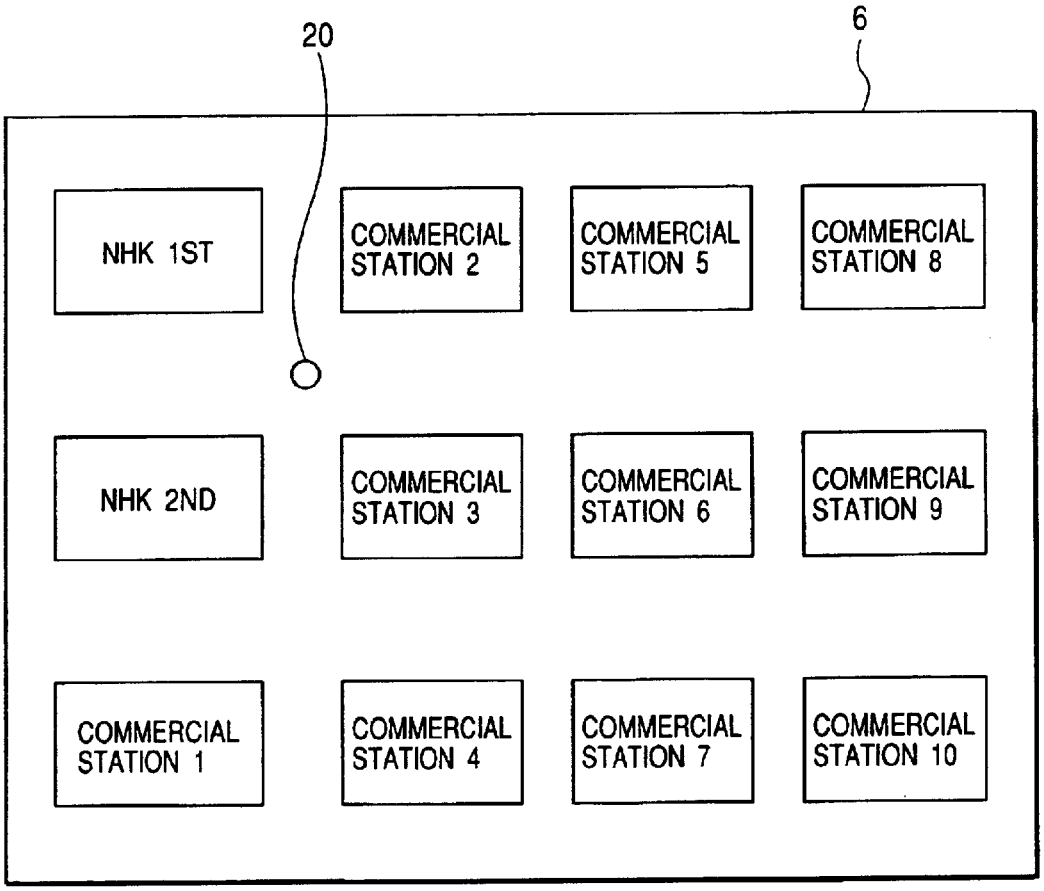
FIG. 10 is also an explanatory view useful for explaining a display content of a monitor.

A preferred embodiment of the invention will be explained with reference to the accompanying drawings. FIG. 1 is a structural view of a force sense imparting type input apparatus according to an embodiment of the invention. FIG. 2 is a perspective view of a stick controller provided to the force sense imparting type input apparatus. FIG. 3 is a transverse sectional view of the stick controller. FIG. 4 is a longitudinal sectional view of the stick controller. FIG. 5 is a sectional view showing an internal construction of an operation knob provided to the force sense imparting type input apparatus. FIG. 6 is a perspective view of the operation knob. FIG. 7 is an explanatory view useful for explaining an operation example of the operation knob. FIGS. 8 to 10 are explanatory views each being useful for explaining a display content of a monitor.

Referring to FIG. 1, a force sense imparting type input apparatus according to this embodiment includes mainly an exterior decoration plate 1 having an opening 1*a*, a stick controller 2 disposed inside the exterior decoration plate 1, an operation lever 3 supported by the stick controller 2 in such a manner as to be capable of rocking, an operation knob 4 fitted to an upper end of the operation lever 3, a control unit 5 and a monitor 6. The exterior decoration plate 1 is a panel such as a center console box inside a car, and the operation lever 3 protrudes into the car through the opening 1*a* of the exterior decoration plate 1.

As shown in FIGS. 2 to 4, the stick controller 2 has a box-shaped casing 7. A pair of rotary bodies 8 and 9 is pivotally supported inside the casing 7 in such a manner as to intersect each other at right angles. Motors 10 and 11 as actuators are fitted to two outer side surfaces of the casing 7 intersecting each other at right angles. The shaft portions of the rotary bodies 8 and 9 are interconnected to spindles of the motors 10 and 11, respectively. Rotary encoders 12 and 13 are coaxially fitted to these motors 10 and 11, respectively. The spindles of the motors 10 and 11 are interconnected to rotors of the encoders 12 and 13, respectively. Both encoders 12 and 13 constitute detection means for detecting an operation condition of the operation lever 3. In other words, the lower end of the operation lever 3 is engaged with the intersecting portion between both rotary bodies 8 and 9. When the operation lever 3 is operated for rocking in an arbitrary direction, the rocking motion is converted to the rotary motion of both rotary bodies 8 and 9, and both encoders 12 and 13 output detection signals corresponding to the rocking amount and to the rocking direction of the operation lever 3. Incidentally, each encoder 12 and 13 has a built-in return spring, and the return springs automatically return the operation lever 3 to a stand-up state.

As shown in FIG. 5, an accommodation portion 3*a* is unitarily formed at the upper end of the operation lever 3 that protrudes from the opening 1*a*. First and second push switches 14 and 15 are fitted inside the accommodation portion 3*a*. The first push switch 14 has a stem 14*a*. When the stem 14*a* is pushed against spring force of the internal return spring, not shown, a moving contact, not shown, comes into contact with a fixed contact and conducts an ON operation. The second push switch 15 has a similar construction, too. The stems 14*a* and 15*a* of the first and second push switches 14 and 15 face each other with a predetermined gap between them. Lead wires 16 are connected to the first and second push switches 14 and 15, pass through the inside of the hollow operation lever 3 and are connected to a control unit 5.

The operation knob 4 is fitted from outside to the accommodation portion 3*a* of the operation lever 3. The operation knob 4 is allowed to reciprocate in an axial direction of the operation lever 3 by using the accommodation portion 3*a* as its slide surface. However, when a stopper protuberance 4*a* of the operation knob 4 is fitted into an engagement hole 3*b* of the accommodation portion 3*a*, the moving distance of the operation knob 4 in the axial direction is limited to a predetermined range and the operation knob 4 is prevented from falling off from the operation lever 3, too. The operation knob 4 has therein a pusher 4*b*. The pusher 4*b* is interposed between the stems 14*a* and 15*a* of the first and second push switches 14 and 15. Therefore, when the pusher 4*b* receives uniform urging force in the vertical direction from the return springs built in the first and second push switches 14 and 15, the operation knob 4 is stably held at a neutral position under a non-load state. When the operation knob 4 is pushed with the neutral position as the reference, the pusher 4*b* turns ON the first push switch 14. When push switch 14 and the operation knob 4 are pulled with the neutral position as the reference, the pusher 4*b* turns ON the second push switch 15.

Referring to FIG. 6, the operation knob 4 includes a large diameter portion 17 positioned outside the accommodation portion 3*a* of the operation lever 3 and having a columnar shape, and a protuberance portion 18 protruding upward from the center of the large diameter portion 17. A constriction 18*a* is formed at a part of the protuberance 18. Knurling 17*a* is disposed on an outer peripheral surface of the large diameter portion 17. Knurling 18*b* is defined as a roughened surface on a spherical ceiling surface of the protuberance 18.

The control unit 5 has a CPU and a memory that are built in the control unit 5. The CPU receives the detection signals outputted from both encoders 12 and 13, decides a first control signal corresponding to the detection signal on the basis of data and a program stored in the memory and outputs this first control signal to both motors 10 and 11. The first control signal is the one that corresponds to an operation feeling imparted to the operation lever 3 and to the operation knob 4. The kind of the signal includes generation of vibration and a change of operation force. When the kind of the signal is the generation of vibration, a first control signal representing the intensity of vibration, the shape of vibration, a load time, a frequency, etc, is generated. When the kind of the signal is the change of the operation force, a first control signal representing the intensity of the operation force, a generation direction of the operation force (that is, resistance force or propelling force), a load time, etc, is generated. The ON signal of the first and second push switches 14 and 15 is inputted to the control unit 5. The control unit 5 outputs a second control signal to the monitor 6 in accordance with the ON signal of the first and second push switches 14 and 15 and the detection signal of both encoders 12 and 13. The second control signal is the one that decides or cancels a selecting operation of the kind and the function of an apparatus displayed on the monitor 6 and displays a cursor corresponding to the operation position of the operation lever 3 on the monitor 6. The monitor 6 is fitted to an instrument panel inside a car.

Next, the operation of the force sense imparting type input apparatus having the construction described above will be explained with reference to FIG. 8 to FIG. 10.

First, when the system of the force sense imparting type input apparatus is activated, four kinds of menus 19*a* to 19*d* of the apparatus such as "AUDIO", "A/C", "NAVI" and "TEL" and the cursor 20 representing the present position of the operation lever 3 are displayed on the monitor 6 as shown in FIG. 8. The starting operation of such a system can be conducted by pushing a start button, not shown, disposed at a predetermined position inside the car, or in the interlocking arrangement with an accessory mode of an ignition key, for example.

When the operation force in the rocking direction is not imparted to the operation lever 3, the operation lever 3 is kept under the standup state at the center position through the return springs of both encoders 12 and 13. When the operator puts his fingers to the operation knob 4 and rocks the operation lever 3 in an arbitrary direction, the control unit 5 receives the detection signals outputted from both encoders 12 and 13 of the stick controller 2 and outputs the second control signal corresponding to the detection signals to the monitor 6. In consequence, the cursor 20 is moved to the position corresponding to the present position of the operation lever 3. The rocking operation of the operation lever 3 can be made by various operation methods as the operator puts his fingers to each part of the operation knob 4 while keeping his palm on the exterior decoration plate 1. More concretely, the operator may put his finger on the ceiling surface of the protuberance portion 18 as shown in FIG. 7A or on the side surface of the protuberance portion 18 as shown in FIG. 7B. Alternatively, the operator may nip the constriction 18*a* of the protuberance portion 18 with his two fingers as shown in FIG. 7C or may nip the large diameter portion 17 with his two fingers as shown in FIG. 7D. Because the operator can operate the operation knob 4 while keeping the palm on the exterior decoration plate 1 in all of these cases, the operator can reliably rock the operation lever 3 in a desired direction.

When the operation lever 3 is rocked in the desired direction in this way and the cursor 20 is moved in the direction of the kind menu 19*a* representing "AUDIO", for example, the control unit 5 receives the detection signals outputted from both encoders 12 and 13 and outputs the first control signal corresponding to the detection signals to both motors 10 and 11. In consequence, the desired operation feeling can be imparted to the operation lever 3. For example, the resistance operation force in the rocking direction of the operation lever 3 is imparted when the cursor 20 reaches the range of the kind menu 19*a*, and the operation force for promoting the rocking direction of the operation lever 3 is imparted when the cursor 20 enters the range of the kind menu 19*a*. Consequently, the operator keeping his fingers put on the operation knob 4 can know through blind-touch the rocking operation of the operation lever 3 in the intended direction. In the case of this example, the operator can know through the click feeling that the cursor 20 reaches the range of the kind menu 19*a* and can then acquire the feeling that the cursor 20 is pulled towards the center of the kind menu 19*a*. Incidentally, when the display color of the kind menu 19*a* is changed in addition to the application of the external force to the operation lever 3 when the cursor 20 reaches the range of the menu 19*a*, the operator can know both haptically and visually that the operation lever 3 is rocked in the intended direction.

As described above, "AUDIO" corresponding to the kind menu 19*a* is selected when the cursor 20 is moved to the central position of the kind menu 19*a*. This operation is decided when the operator operates and pushes the operation knob 4 in the axial direction of the operation lever 3. In other words, when the operator pushes the operation knob 4, the pusher 4*b* pushes the stem 14*a* of the first push switch 14 and the first push switch 14 is turned ON. The control unit 5 receives this ON signal and outputs the second control signal to the monitor 6. In consequence, the display screen of the monitor 6 changes to four kinds of menus 21*a* to 21*d* of "RADIO (AM)", "RADIO (FM)", "CASSETTE" and "CD". Such a push operation of the operation knob 4 is conducted as the operator pushes the ceiling surface of the protuberance portion 18 with his finger as shown in FIG. 7A, or nips and pushes the constriction 18*a* of the protuberance portion 18 with two fingers as shown in FIG. 7C, or nips and pushes the large diameter portion 17 with two fingers as shown in FIG. 7D. In either case, the push operation can be continuously conducted while the operation lever 3 is operated for rocking.

In this case, too, the operation is conducted in the same way as described above. When the operation lever 3 is operated for rocking in such a manner as to move the cursor 20 on the menu 21*a*, for example, and when the operation knob 4 is pushed under this state, "RADIO (FM)" is selected and the display screen of the monitor 6 changes to "NHK 1ST", "NHK 2ND", "COMMERCIAL STATIONS 1 TO 10", etc, as shown in FIG. 10. When the operation lever 3 is rocked to select "NHK 1ST", for example, and the operation knob 4 is pushed to decide the menu, the operator can listen to the NHK 1st program from the car radio.

When the operator desires to cancel the menu selected by rocking the operation lever 3 in the menu selection operation described above, the operator pulls the operation knob 4 in the axial direction of the operation lever 3 and can thus cancel the selected menu. For example, when the operation knob 4 is pulled under the state where the menu shown in FIG. 10 is displayed on the monitor 6 and the cursor 20 is moved to select "NHK 1ST", the pusher 4*b* pushes the stem 15*a* of the second push switch 15 and the second push switch 15 is turned ON. The control unit 5 receives this ON signal and outputs the second control signal to the monitor 6. In consequence, the selection of "NHK 1ST" is cancelled and the display screen of the monitor 6 returns to the state shown in FIG. 10. The operator can conduct the pull operation of the operation knob 4 by nipping and lifting up the constriction 18*a* of the protuberance portion 18 with two fingers as shown in FIG. 7C or nipping and lifting up the large diameter portion 17 with two fingers as shown in FIG. 7D. In either case, the pull operation can be continuously conducted while the operation lever 3 is rocked.

The explanation given above represents the case of "selection of radio stations" from an audio apparatus, but the selection operation of functions of other apparatuses is basically the same with the exception that the display of the monitor 6 changes. For example, it is possible to select temperature adjustment and wind quantity adjustment of an air conditioner when "A/C" is selected from the kind menus 19*a* to 19*d* shown in FIG. 8.

In the force sense imparting type input apparatus according to this embodiment, the first push switch 14 is turned ON when the operation knob 4 fitted to the end part of the operation lever 3 is pushed, and the second push switch 15 is turned ON when the operation knob 4 is pulled. Therefore, the operations of selecting and deciding the menu or canceling the menu can be continuously conducted through the rocking operation of the operation lever 3 and the push/pull operation of the operation knob 4, and maneuverability can be remarkably improved. The operation knob 4 has the large diameter portion 17 and the protuberance portion 18, and the constriction 18*a* is defined at a part of the protuberance portion 18. Therefore, the operator can easily conduct the push/pull operation by nipping the large diameter portion 17 or the constriction 18*a* of the protuberance portion 18 with two fingers, or putting the finger onto the ceiling surface of the protuberance portion 18. Furthermore, because knurling 17*a* and 18*b* is disposed on the outer peripheral surface of the large diameter portion 17 and on the ceiling surface of the protuberance portion 18, slip of the fingers can be prevented and in this point, too, maneuverability can be improved.

Figure 11A:
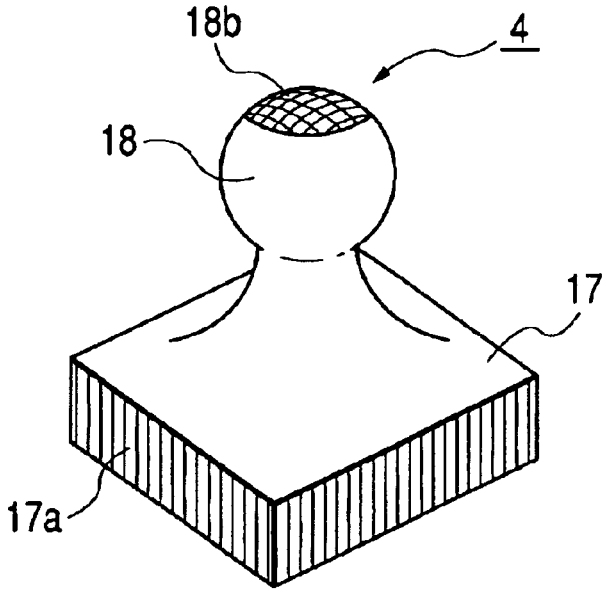
FIGS. 11A and 11B are perspective views showing a modified example of the operation knob.
Figure 11B:
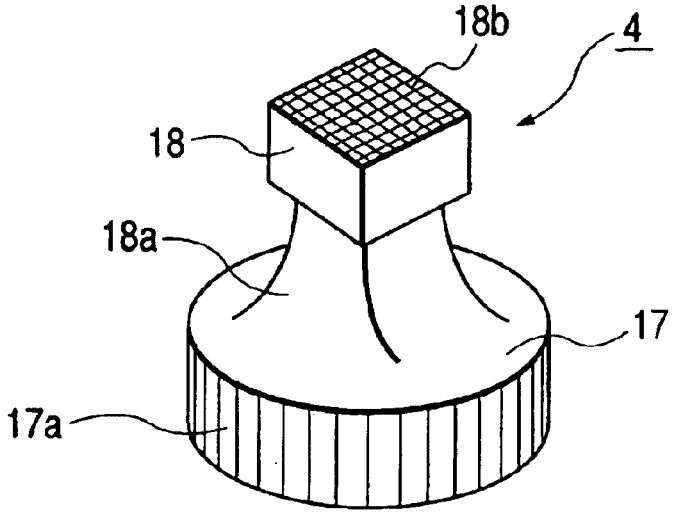

Incidentally, the shape of the operation knob 4 is not particularly limited to the shape in the embodiment described above. For example, the large diameter portion 17 may have a prismatic shape as shown in FIG. 11A, the protuberance portion 18 may have a prismatic shape as shown in FIG. 11B or both large diameter portion 17 and protuberance portion 18 may have a prismatic shape. When the planar shape of at least one of the large diameter portion 17 and the protuberance portion 18 has a rectangular shape, the operator can know through blind touch the rocking direction of the operation lever 3 from the outer shape of the operation knob 4 when the operator puts his finger to each part of the operation knob 4.

The invention is practiced in the form explained above and provides the following effects.

When the operation knob provided to the end part of the operation lever is pushed, one of the switches is operated and when the operation knob is pulled, the other switch is operated. Therefore, the operator can continuously conduct the rocking operation of the operation lever and the push-pull operation for switching, and a force sense imparting type input apparatus that is easy-to-operate and is excellent in an operation factor can be accomplished.

What is claimed is:

1. An input apparatus comprising:

an exterior decoration plate having an opening;

an operation lever having a support point thereof positioned inside said exterior decoration plate and so supported as to be capable of rocking;

detection unit to detect an operating condition of said operation lever; and control unit to control a monitor displaying functions in accordance with an output signal outputted from said detection unit;

wherein an operation knob is provided to an end part of said operation lever protruding outward from said opening, a push-pull operation is allowed in an axial direction of said operation lever with a neutral position of said operation knob as a reference, the push-pull operation of said operation knob selectively operates two switches, and said control unit activates or cancels a selected operation of said functions in accordance with signals received from the two switches.

2. The input apparatus according to claim 1, wherein said operation knob includes a large diameter portion with said operation lever being a proximal end side, and a protuberance portion protruding from said large diameter portion.

3. The input apparatus according to claim 2, wherein a constriction is defined at a part of said protuberance portion.

4. The input apparatus according to claim 3, wherein a ceiling surface of said protuberance portion contains knurling.

5. The input apparatus according to claim 3, wherein at least one of said large diameter portion and said protuberance portion has a rectangular planar shape.

6. The input apparatus according to claim 2, wherein a ceiling surface of said protuberance portion contains knurling.

7. The input apparatus according to claim 6, wherein at least one of said large diameter portion and said protuberance portion has a rectangular planar shape.

8. The input apparatus according to claim 2, wherein at least one of said large diameter portion and said protuberance portion has a rectangular planar shape.

9. The input apparatus according to claim 1, wherein said two switches are push switches, said push switches are so arranged on said operation lever as to face each other, and a pusher is provided to said operation knob at a position between stems of said push switches.

10. The input apparatus according to claim 1, further comprising an actuator to impart external force to said operation lever.

* * * * *